United States Patent [19]

Yabuki et al.

[11] Patent Number: 4,827,999

[45] Date of Patent: May 9, 1989

[54] POLYESTER FIBER . . . THE PRODUCTION THEREOF

[75] Inventors: Kazuyuki Yabuki, Otsu; Yohji Kohmura; Mitsuo Iwasaki, both of Tsuruga; Hiroshi Yasuda, Otsu, all of Japan

[73] Assignee: Toyobo Petcord Co., Ltd., Osaka, Japan

[21] Appl. No.: 725,516

[22] Filed: Apr. 22, 1985

Related U.S. Application Data

[63] Continuation of Ser. No. 446,112, Dec. 2, 1982, abandoned.

[30] Foreign Application Priority Data

Dec. 2, 1981 [JP] Japan ..... 56-194129

[51] Int. Cl.[4] ..... D02G 3/48

[52] U.S. Cl. ..... 152/451; 264/210.8

[58] Field of Search ..... 152/451, 527, 556, 565; 428/295; 156/910; 264/210.7, 210.8, 117.13; 57/902

[56] References Cited

U.S. PATENT DOCUMENTS

| | | | |
|---|---|---|---|
| 3,051,212 | 8/1962 | Daniels | 152/330 R |
| 3,616,832 | 11/1971 | Shima et al. | 152/359 |
| 3,665,994 | 5/1972 | Kovac et al. | 152/359 |
| 4,101,525 | 7/1978 | Davis et al. . | |
| 4,195,052 | 3/1980 | Davis et al. . | |
| 4,414,169 | 11/1983 | McClary | 264/210.7 |
| 4,715,418 | 12/1987 | Miyoshi et al. | 152/451 |

FOREIGN PATENT DOCUMENTS

| | | |
|---|---|---|
| 49768 | 12/1972 | Japan . |
| 31852 | 3/1978 | Japan . |
| 57070 | 4/1980 | Japan . |
| 55-118855 | 9/1980 | Japan . |
| 116816 | 9/1986 | Japan . |
| 585994 | 3/1981 | United Kingdom . |

*Primary Examiner*—Michael W. Ball
*Assistant Examiner*—Ramon R. Hoch
*Attorney, Agent, or Firm*—Jones, Tullar & Cooper

[57] ABSTRACT

A polyester fiber having excellent thermal dimensional stability and chemical stability as well as high tenacity, which is a drawn yarn produced by melt-spinning a polyester comprising predominantly polyethylene terephthalate, solidification the spun yarn and then drawing the yarn under specified conditions and has specified properties such as intrinsic viscosity, diethylene glycol content, carboxyl group content, birefringence, yarn tenacity and difference of average birefringence between surface and center of monofilament, and further low dry heat shrink and work loss when heat-treated, said polyester fiber being useful as a reinforcement for rubber goods, specifically as a tire cord, and processes for the production of the polyester fiber.

10 Claims, 1 Drawing Sheet

Figure 1:
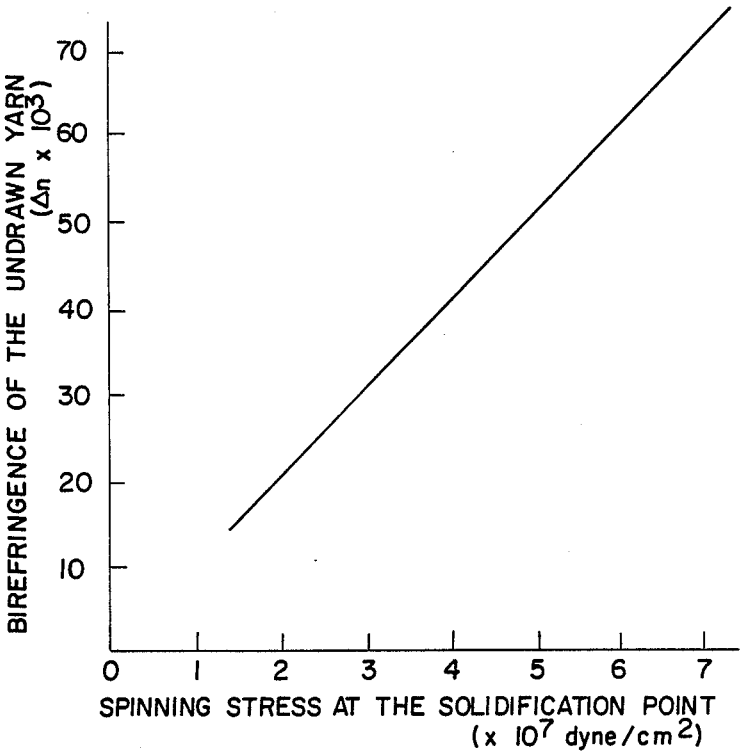

POLYESTER FIBER HAVING EXCELLENT THERMAL DIMENSIONAL STABILITY, CHEMICAL STABILITY AND HIGH TENACITY AND PROCESS FOR THE PRODUCTION THEREOF

This is a continuation of application Ser. No. 446,112, filed on Dec. 2, 1982, now abandoned.

The present invention relates to a polyester fiber having excellent thermal dimensional stability, chemical stability, as well as high tenacity; and to a process for the production thereof.

Polyester yarns having high tenacity, particularly polyester tire yarn, are organic fibers having well balanced physical properties and have widely and greatly been used in various industries.

In spite of recent significant increases in the cost of the starting materials of organic fibers, the cost of the starting materials of polyesters, particularly of polyethylene terephthalate, is less increased in comparison with that of other organic fibers, such as nylon 6, and it is expected that this stable cost of polyesters will be maintained in future. This fact may promote enlarged demand for polyester high tenacity yarns.

However, the conventional polyester yarns do not have satisfactory thermal dimensional stability and chemical stability and further lack adhesion with materials to be reinforced (e.g. rubbers) in some cases, and hence, it is required to improve these properties.

Methods for improving the above properties of polyester yarns have been proposed. For instance, as to improvement of thermal dimensional stability, there have been proposed polyester fibers having a comparatively lower intrinsic viscosity (cf. Japanese Patent Laid Open Application No. 31852/1978), polyester fibers obtained by drawing a highly orientated undrawn yarn (so-called "POY" which is an abbreviation of partially orientated yarn) (cf. U.S. Pat. No. 4,195,052), and polyester fibers irradiated by electron rays (cf. Japanese Patent Laid Open Application No. 57070/1980). As to improvement of chemical stability, there has been proposed a method of lowering the content of carboxyl end group (hereinafter referred to as "carboxyl group") in the polyester (cf. Japanese Patent Laid Open Application No. 116816/1980). Moreover, as to improvement of adhesion with rubbers, there has been proposed a method of treating the polyester with a chemically active epoxy or isocyanate compound in the steps of spinning and drawing (cf. Japanese Patent Publication No. 49768/1972) and a method of treating the polyester with the above chemically active compound in a dipping process (cf. Japanese Patent Laid Open Application No. 116816/1980).

These proposed methods can improve the properties to some extent, but such methods, resulting in a tradeoff of properties, are not yet satisfcatory in order to make them suitable for recent significant technical developments.

Among the known methods, the method of lowering the intrinsic viscosity has a drawback that the tenacity of cord and fatigue resistance is deteriorated in return for improvement of dimensional stability when the fiber is used as a tire reinforcement. Besides, the fibers obtained by drawing POY as disclosed in U.S. Pat. No. 4,195,052 show deteriorated toughness in return for improvement of dimensional stability when used as a tire reinforcement. Moreover, these polyester fibers are inferior in the chemical stability in comparison with the conventional high tenacity polyester fibers, particularly showing deterioration with amines contained in rubbers or with water, because these fibers mainly contain the tie-molecule chain which contributes highly to the tenacity of fibers at the surface region. The method of improving the dimensional stability by forming three-dimensional crosslinking with electron ray irradiation or with crosslinking agents also has a drawback in that the toughness and fatigue resistance of yarn are likewise deteriorated in return for improvement of dimensional stability, and it is merely an improvement by trading off of properties, i.e. an improvement of one property at the sacrifice of other properties.

Besides, the method of improving chemical stability by lowering the carboxyl group content and the method of improving the adhesion of polyester fiber are insufficient for improving dimensional stability for the purpose of using the fibers as a reinforcement in heavy duty vehicles and cannot give the desired polyester fibers.

Under the circumstances, the present inventors have made an extensive study on the properties of polyester fibers and have found that a polyester fiber having specific physical properties which are prepared by spinning and drawing the starting polyester under specific conditions can satisfy the desired excellent thermal dimensional stability and chemical stability requirements without deteriorating high tenacity.

An object of the present invention is to provide an improved polyester fiber having excellent thermal dimensional stability and chemical stability as well as high tenacity. Another object of the present invention is to provide a high tenacity yarn which is useful as a reinforcement for rubbers in tires, V belts, conveyor belts, or the like. A further object of the present invention is to provide a process for producing the polyester fiber. These and other objects and advantages of the present invention will be apparent to persons skilled in the art from the following description.

The polyester fiber having excellent thermal dimensional stability and chemical stability as well as high tenacity of the present invention is a drawn yarn produced by melt-spinning a polyester comprising predominantly polyethylene terephthalate, solidifying the spun yarn with cooling and then drawing the yarn. The polyester fiber has the following properties:

(i) intrinsic viscosity: 0.8 or more, (ii) content of diethylene glycol: 2.5% by mole or less of terephthalic acid residue, (iii) content of carboxyl groups: 30 equivalent/$10^6$ g or less, (iv) average birefringence: 0.190 or more, (v) yarn tenacity: 8.5 g/d or more, and (vi) value obtained by dividing the difference of birefringence between surface and center of monofilament by average birefringence: 0.055 or less, and further has the following properties when it is heat-treated at constant length at 240° C. for one minute:

(a) dry heat shrink when freely heat-treated at 175° C. for 30 minutes: 3.0% or less, and (b) work loss when the hysteresis loop is measured at a stress between 0.6 g/d and 0.05 g/d under the following conditions: length of test sample of 10 inch, strain rate of 0.5 inch/minute and a temperature of 150° C.: $2.0\times10^{-5}$ inch.pound/denier or less.

Moreover, when the fiber has a carboxyl group content of 20 equivalent/$10^6$ g or less and is subjected to a surface treatment with a chemically active epoxy or isocyanate compound in the spinning and drawing steps, the fiber shows more improved properties suitable for using the fiber as a reinforcement of rubber goods.

The process of the production of the fiber and theoretical background thereof are explained below.

As a result of intensive study by the present inventors, it has been found that when the phase of the fiber in which no crystalline diffraction is observed by wide angle X-ray diffraction is defined as amorphous, the fiber obtained by drawing an undrawn yarn which is in the state in which molecules are orientated to some extent while being amorphous (for instance, polyethylene terephthalate having a birefringence of $10\times10^{-3}$ or more) shows smaller heat shrinkage in comparison with a fiber obtained by drawing an undrawn yarn which is amorphous and in which molecules are not orientated (wherein both fibers are drawn so as to show the same birefringence and are heat-treated at a temperature near to the melting point for some minutes at constant length in order to eliminate the difference of thermal history in the drawing process). It is assumed that when the amorphous undrawn fiber which has molecular orientation to some extent (but orientation-induced crystallization does not occur) is drawn, the drawn yarn shows a small substantive residual strain caused by drawing in comparison with the drawn yarn obtained by drawing the amorphous fiber in which molecules show random orientation or slight orientation. Besides, it is reported by Yasuda et al that the molecular orientation of spun yarn in a melt-spinning process depends on the spinning stress at the solidification point thereof (cf. Yasuda et al, Sen-i-Gakkai-shi, Vol. 34, P-20, 1978). Based on this background, the present inventors have intensively studied the conditions of spinning and drawing steps and have found the following facts:

(A) Under the conditions of melt-spinning wherein the yarn is solidified at high speed, the difference in tensile viscosity of the polymer melt in each filament is large because of the large difference in temperature between the inner and outer layers of each filament, which results in the occurrence of a difference in of spinning stress between the inner and outer layers of filament at the solidification point thereof and then in an enlarged difference in birefringence between the inner and outer layers of filament (i.e. difference of degree of orientation of the molecular chain). Accordingly, the maximum draw ratio is determined merely by the surface area of the filament where orientation progresses quickly as compared with the inner part of a filament by drawing, and the inner part where orientation does not progress satisfactorily shows lower tenacity as compared with surface area, and hence, the yarn can hardly show high tenacity.

(B) However, when the temperature of air used for quenching the molten filament is raised and further the solidification point of yarn is kept away from the spinneret so as to decrease the difference in the temperature between inner and outer layers of filament at the solidification point, the distribution of molecular orientation degree of the spun filaments becomes narrower, and thereby the drawn yarn obtained from the spun yarn can show high tenacity even though it is produced through POY.

The polyester of the present invention should have 95% by mole or more of polyethylene terephthalate units as the component unit and should have an intrinsic viscosity of 0.80 or more, preferably 0.80 to 2.0 (when measured at 30° C. in a mixed solvent of phenol/tetrachloroethane=6/4) in view of utilities as high tenacity fibers in various industries.

The polyester yarn is occasionally heat-treated at a temperature near the melting point during usage thereof, and the melting point of polyester lowers with an increase in content of diethylene glycol component, and hence, the diethylene glycol content of the polyester is a very important factor. Thus, the polyester fiber of the present invention should have a diethylene glycol component content of 2.5% by mole or less of the terephthalic acid residue.

In order to use the polyester fiber of the present invention as an reinforcement for rubber goods, the polyester fiber should have a carboxyl group content of 30 equivalent/$10^6$ g or less, preferably 20 equivalent/$10^6$ g or less, more preferably 12 equivalent/$10^6$ g or less, for effectively preventing undesirable deterioration of properties due to attack by amines and/or water contained in rubber goods or with water.

The polyester fiber should have a yarn tenacity of 8.5 g/d or more, and for such a purpose, the polyester fiber should have an average birefringence of 0.190 or more, preferably of 0.190 to 0.210, in addition to other requirements.

The polyester fiber of the present invention is produced by spinning the starting polyester under a comparatively high spinning stress, i.e. under a spinning stress at a solidification point of $1.5\times10^7$ to $7.5\times10^7$ dyne/cm$^2$, followed by drawing as is explained hereinafter, wherein the difference of birefringences between the surface and center of monofilament of spun yarn should be 10% or less in order to make the average birefringence of drawn filament 0.190 or more, otherwise, the drawing is very difficult on an industrial scale. According to experiments by the present inventors, when a spun yarn having a difference of birefringence between the surface and center of monofilament of 10% or less is drawn to obtain a high tenacity yarn having a yarn tenacity of 8.5 g/d or more, the difference of birefringences between the surface and center of a monofilament of drawn yarn is less than 5.5%. Therefore, the yarn has uniform distribution (not mainly located at the surface area) of tie-molecular chains which contribute to the tenacity of the fiber and hence can maintain the high tenacity thereof even if it is kept at an atmosphere where the yarn is deteriorated from the surface thereof, while the polyester tire yarn drawn with POY which is produced by prior art cannot maintain the tenacity. Thus, it is important that the polyester fiber of the present invention has a specified difference of birefringence between the surface and center of filament of drawn yarn.

As is disclosed in British Pat. No. 1,585,944 by the present inventors, the properties, particularly dynamic properties, of the high tenacity yarn useful as a reinforcement for rubber goods after being heat-treated in a dipping process are important, because even if the properties before dipping may demonstrate a big difference owing to the difference of production processes, the properties after dipping are less different. Thus, the properties such as low shrinkage and low work loss of the polyester fiber of the present invention are important for actual use in some utilities, and the polyester fiber before dipping is not always required to have low shrinkage and low work loss.

Thus, in case of heat-treating at constant length at 240° C. for one minute (in dipping process), the drawn yarn of the present invention has a dry heat shrink of 3.0% or less when the yarn is freely heat-treated at 175° C. for 30 minutes and a work loss of $2.0\times10^{-5}$ inch-.pound/denier or less (i.e. 0.0200 inch.pound or less per 1000 deniers) when the hysteresis loop is measured at a stress between 0.6 g/d and 0.05 g/d under the conditions length of test sample of 10 inches, strain rate of 0.5 inch/minute and a temperature of 150° C. Thus, the polyester fiber of the present invention shows high tenacity while it has low shrinkage and low work loss, and the high tenacity yarn of the present invention is particularly useful as a reinforcement for rubber goods, for instance, for tires, V belts, conveyor belts, or the like.

The difference of birefringence between the surface and center of monofilament is measured by the method of Shimizu et al (cf. Shimizu et al, Sen-i-Gakki-Shi, Vol. 37, T-135, 1981), and the work loss is measured by the method disclosed in U.S. Pat. No. 4,195,052.

As a result of intensive study by the present inventors, the desired polyester fiber can be produced on an industrial scale by the POY spinning with quenching air having a comparatively high temperature, and drawing the POY by a spin-draw process wherein two drawing stages are provided, with high temperature steam being used in the first drawing stage, and a contact-heat transfer device such as hot roll or hot plate being used in the second drawing stage. Said process is excellent from the viewpoint of easy operability for production as well as from an economical viewpoint.

Generally speaking, the drawing of POY by a spin-draw process should be done at an extremely high speed. Accordingly, the drawing is very difficult, and hence, the drawing of POY by a spin-draw process is not suitable from an economical viewpoint. From this viewpoint, the method disclosed in U.S. Pat. No. 4,195,052 is carried out by first stage drawing at on-line and thereafter subjecting to the second stage drawing at off-line, which is not the spin-draw process.

According to the prior art of spin-draw process, the drawing of POY which must be drawn at a high speed cannot give a satisfactory result on an industrial scale. For instance when two drawing stages are applied wherein a contact type heat transfer device such as hot roll is used in each stage, the operability is bad as is shown in Example 1, 'D' hereinafter. Besides, when the drawing is carried out by using heated steam in only one drawing stage, too large an amount of steam is required as is shown in Example 1, 'E' hereinafter. Thus, both methods are not satisfactory from an industrial viewpoint.

The present inventors have found an improved process for producing the desired polyester fiber having excellent thermal dimensional stability and chemical stability as well as high tenacity which is economical and is carried out with improved operability in the drawing process.

The process of the present invention comprises melt-spinning a polyester comprising ethylene terephthalate as the main repeating unit and having an intrinsic viscosity of 0.8 or more (measured at 30° C. in a mixed solvent of phenol/tetrachloroethane=6/4) through a spinneret of a throughput of not more than 3.5 g/minute per each orifice of the spinneret, quenching the spun yarn with quenching air at 35° to 80° C., pulling out the spun yarn with a spinning stress at the solidification point thereof of $1.5\times10^7$ to $7.5\times10^7$ dyne/cm$^2$, subjecting the yarn to a first drawing by passing through a device for fixing the drawing point wherein heated steam at 400° to 650° C. is used between a first godet roll and a second godet roll at a draw ratio (D) of the following formula:

$$0.70Y \leqq D \leqq 0.90Y \quad (1)$$

wherein Y is a value of the following formula:

$$Y=6.834\times10^{-4}33\ B^2-0.0874\times B+4.816 \quad (2)$$

wherein B is an average birefringence of the spun yarn x $10^3$, subjecting the resulting yarn to the second drawing between a second godet roll and a third godet roll at a temperature of 180° C. to a melting point thereof and at a draw ratio of 1.05 to 1.20, and then winding up the drawn yarn directly, or optionally after being slightly relaxed, with a fourth godet roll to give a polyester fiber having excellent thermal dimensional stability and chemical stability as well as high tenacity.

The polyester fiber of the present invention is intended to be used mainly as a high tenacity fiber in various industries, and hence, the fiber should have 95% by mole or more of ethylene terephthalate units as the repeating unit and should have an intrinsic viscosity of 0.8 or more. When the intrinsic viscosity of the fiber is less than 0.8, it has lower tenacity and is not suitable for such a purpose.

In the spinning step in the above process of the present invention, the starting polyester should be spun through a spinneret at a throughput per each orifice of not more than 3.5 g/minute. When the amount is over 3.5 g/minute, the spun yarn shows a large difference in birefringence of each filament between the inner and outer layers, which results in less effectivity of quenching with high temperature quenching air and in lower birefringence of the spun yarn, and hence, there cannot be obtained the desired high tenacity fiber with low shrink which is useful as a reinforcement for rubber goods.

The molten threads just extruded from spinnerets are quenched with hot air directly (i.e. without passing through a quench collar) or after passing through a quench collar. That is, the spun yarn is quenched with quenching air having a comparatively high temperature such as 35° to 80° C., preferably 60° to 80° C. at an air velocity of 20 to 100 cm/second until the solidification point of the yarn. According to the quenching in the above-mentioned manner, the temperature difference between the inner and outer layers of the filament at the solidification point thereof is significantly decreased, which results in extremely decreased difference of degree of orientation of molecular chain of the spun yarn between the inner and outer layers of the filament. For instance, when the temperature of the quenching air is varied from 20° C. to 50° C., the difference of birefringence between the surface and center of the monofilament of the spun yarn decreases from 15% to 5%. When the temperature of the quenching air is lower than 35° C., the drawn yarn shows low tenacity and the operability of the process is also lowered. On the other hand, when the temperature of the quenching air is higher than 80° C., the utility cost thereof is increased and further the distance between the spinneret surface and the position of solidification point of the yarn is extremely elongated, and hence, the process cannot practically be used on an industrial scale.

In the process of the present invention, the spinning stress of the spun yarn at the solidification point of the yarn is also very important, because the birefringence of the spun yarn depends on the spinning stress at the solidification point. The spinning stress of the spun yarn after solidification thereof is simply and mainly increased with the spinning stress owing to air friction, but it has no relation with the orientation of molecular chain. Accordingly, it is important to control the spinning stress at the solidification point of the yarn in order to control the birefringence of spun yarn. Main factors effecting the spinning stress at the solidification point of yarn are throughput of the starting polymer from each orifice, the distance between the spinnerets, and the position where the yarn is exposed to the quenching air, and the speed of spinning. In the present invention, various spinning conditions are controlled so as to define the spinning stress at the solidification point in the range of $1.5\times10^7$ to $7.5\times10^7$ dyne/cm$^2$, preferably $2.0\times10^7$ to $6.5\times10^7$ dyne/cm$^2$. When the spinning stress at the solidification point is lower than $1.5\times10^7$ dyne/cm$^2$, it is impossible to obtain the desired polyester fiber having low shrink which is one of the most important properties in the present polyester fiber. When the spinning stress at the solidification point is larger than $7.5\times10^7$ dyne/cm$^2$, the spun yarn is already crystallized (determined by a wide angle X-ray diffraction), and hence, the spun yarn filament has an extremely large birefringence distribution and the polyester fiber obtained after drawing has a low tenacity. The attached FIG. 1 shows the relation between the spinning stress at the solidification point and the birefringence ($\Delta n$) of the undrawn yarn (POY).

In the process of the present invention, it is essential to draw the spun yarn by using two drawing stages in a spin-draw process in order to produce the desired high tenacity yarn having excellent thermal dimensional stability and chemical stability, by which the desired fiber having excellent properties can economically be produced with low utility cost.

As a result of intensive study on the two stage drawing system, it has been found that the first drawing is preferably carried out by using heated steam at 400° to 650° C. at a draw ratio as defined by the formula (1), and the second drawing is preferably carried out at a temperature of 180° C. to the melting point of the yarn at a draw ratio of 1.05 to 1.20.

In the first drawing stage, the spun yarn is heated with the heated steam at 400° to 650° C. The temperature of steam is very important, and when the temperature is lower than 400° C., too much steam is required, and when the temperature is too low, the yarn cannot be drawn to achieve the desired draw ratio. On the other hand, when the temperature of steam is higher than 650° C., the yarn is molten and hence the desired fiber cannot be obtained.

The formula (1) for obtaining the optimum draw ratio is derived in the following manner:

Several kinds of unknown yarns (POY) are drawn with a drawing machine at a feeding speed of 100 m/minute, a surface temperature of the feeding roll of the formula:

$$[90+(IV-0.6)\times4.5-\overline{\Delta}nPOY\times280]^\circ\ C.-5^\circ\ C. \quad (3)$$

wherein IV equals the intrinsic viscosity of the starting polymer solution, and $\overline{\Delta}nPOY$ equals the average birefringence of POY, at a temperature of the hot plate of 230° C., and at a temperature of the draw-roll of 140° C., in this step, the draw ratio at break is measured by drawing the yarns by increasing the speed of the draw roll. Based upon the draw ratio at least (Y) and the birefringence of the spun yarn, secondary regression analysis is made which leads to the formula (2), and then, the formula (1) is given based upon the formula (2).

When the first drawing is carried out under the above conditions, it can be done with good operability by using a minimum amount of steam per the weight of the final fiber product.

The second drawing is carried out at a temperature of 180° C. to the melting point of the yarn, preferably 200° to 240° C. When the temperature is lower than 180° C., drawing is impossible because of significant breaking of filaments, and when the temperature is higher than the melting point of the yarn, drawing is impossible because of melting of the yarn. Besides, the second drawing is carried out at a draw ratio of 1.05 to 1.20. When the draw ratio is higher than 1.20, the draw ratio is over the maximum draw ratio, which results in significant breaking of filaments, and on the other hand, when the draw ratio is lower than 1.05, the desired yarn having high tenacity cannot be obtained.

After drawing, the drawn yarn is preferably taken off at a speed of 5,500 m/minute or less. When the speed of take off is over 5,500 m/minute, the drawing speed becomes too high which results in significant breaking of filaments and in difficulty in operation.

Alternatively, the polyester fiber having excellent properties of the present invention can be produced by the following process.

The alternative process comprises melt-spinning a polyester comprising ethylene terephthalate as the main repeating unit and having 0.8 or more of an intrinsic viscosity (measured at 30° C. in a mixed solvent of phenol/tetrachloroethane=6/4) through a spinneret in throughput of not more than 3.5 g/minute per each orifice of the spinneret, quenching the molten filaments with a quenching air of 35° to 80° C., pulling out the spun yarn in a yarn spinning stress at the solidification point $1.5\times10^7$ to $7.5\times10^7$ dyne/cm$^2$, and subjecting the spun yarn to multiple drawing with heated rolls subsequently to the above quenching step or after being wound on a winding roll to give the desired polyester fiber having thermal dimensional stability and chemical stability as well as high tenacity.

In the multiple drawing of the above alternative process, the number of drawing stages is not limited but is usually three stages. The multiple drawing is carried out under the following conditions in each drawing stage.

In the first drawing stage, it is done at a surface temperature of the first drawing roll (the first godet roll) of not higher than the temperature of the formula:

$$[90+(IV-0.6)\times4.5-\overline{\Delta}nPOY\times280]^\circ\ C. \quad (3')$$

wherein IV and $\overline{\Delta}nPOY$ are as defined in the above formula (3), but not lower than 69° C., and at a draw ratio (D) of the formula:

$$0.60Y\leqq D\leqq0.85Y \quad (1')$$

wherein Y is as defined in the formula (2).

In the second drawing stage, it is done at a surface temperature of the second drawing roll (the second godet roll) of 120° to 180° C. and at a draw ratio of 1.15 to 1.50.

In the third drawing stage, it is done at a surface temperature of the third drawing roll (the third godet roll) of 180° to 240° C. and at a draw ratio of 1.05 to 1.20.

According to this multiple drawing system, the drawing temperature in the first drawing stage should be higher than the glass transition temperature of the yarn, but on the other hand, it is not suitable to draw it at such a high temperature as in the conventional process, because the yarn to be drawn is POY and hence it is crystallized before drawing or at an early stage of the drawing if it is done at too high a temperature as in the conventional process, which results in an insufficient draw ratio in the later stage. Thus, it is important to specify the surface temperature of the first godet roll based on the IV and $\overline{\Delta n}$ of yarn. Besides, when the draw ratio at the first drawing stage is less than 60% of the maximum draw ratio Y, the drawn yarn contains a partially undrawn part, which results in significant unevenness of yarn and less operability. Besides, when the yarn ratio is over 85% of the maximum draw ratio Y, the drawing at the later stage becomes less effective and less operational. The second and subsequent drawings may be carried out under the same conditions as in the conventional process, wherein the temperature of the later roll is about 30° C. higher than that of the former roll. That is, the above-mentioned temperature range and draw ratio range are suitable.

Moreover, the present inventors have found that the desired polyester fiber having excellent thermal dimensional stability and chemical stability as well as high tenacity can also be produced by another process wherein POY having less difference of molecular orientation between the inner and outer layers of filaments thereof is used and the POY is spun at a comparatively lower spinning speed, which is characteristic in that the spun yarn is quenched spontaneously, i.e. without using any specific quenching air.

It is known that POY is thermally stable (cf. Japanese Patent Publication No. 6729/1980) and that the fiber produced by drawing POY is also thermally stable. It is industrially advantageous to produce POY at a comparatively lower spinning speed, because the speed of the final take-off step is also made slow.

In order to produce a highly orientated POY at a comparatively lower spinning speed, the spun yarn may be quenched with quenching air having a higher temperature as mentioned above, but it results disadvantageously in increase of energy cost. From this viewpoint, in this alternative process, the molten filament extruded from the spinneret are quenched spontaneously, i.e. without using any specific quenching air contrary to the common experience in this field.

That is, the further alternative process of the present invention comprises melt-spinning a polyester comprising ethylene terephthalate as the main repeating unit and having an intrinsic viscosity of 0.8 or more of (measured at 30° C. in a mixed solvent of phenol/tetrachloroethane=6/4) through a spinneret with a throughput of not more than 3.5 g/minute per each orifice of the spinneret, quenching the spun yarn without using any quenching air, pulling out the spun yarn at the spinning stress at the solidification point of $1.5\times10^7$ to $7.5\times10^7$ dyne/cm$^2$, bundling the yarn at 20 to 100 cm below the position of solidification of the yarn and then subjecting the bundle to drawing by a spin-draw method via the first godet roll at a speed of 1,500 m/minute or higher, by which the desired polyester fiber having excellent thermal dimensional stability and chemical stability as well as high tenacity can be produced at very low cost.

This alternative process and technical background thereof are explained below.

When the spinning is carried out without using any quenching air, the extruded molten filaments are cooled very slowly and the solidification point occurs far from the spinneret, which results in increased spinning stress at the solidification point and in increased birefringence of POY. Moreover, the difference of temperature between the inner and outer layers of filament at the solidification point thereof is remarkably decreased, which results in remarkable decrease of difference of molecular orientation between the inner and outer layers of filament. When the spun yarn is cooled with quenching air, the quenching conditions are different among the filaments and hence the degree of molecular orientation is different among the filaments, which are more significant when a spinneret having many orifice holes is used. However, when no quenching air is used as in the alternative process of the present invention, such differences do not occur. Accordingly, the POY by the present invention has good uniformity and the maximum draw ratio becomes larger than the case of the conventional POY process when the yarns show the same average birefringence in both processes, and the fiber obtained by the present invention has higher tenacity.

The alternative process of the present invention can give POY having excellent properties of yarn in good productivity. A particularly advantageous point of this process is that the cost for apparatus is largely saved because neither energy for supplying quenching air nor a device for supplying the quenching air is required.

Figure 2:
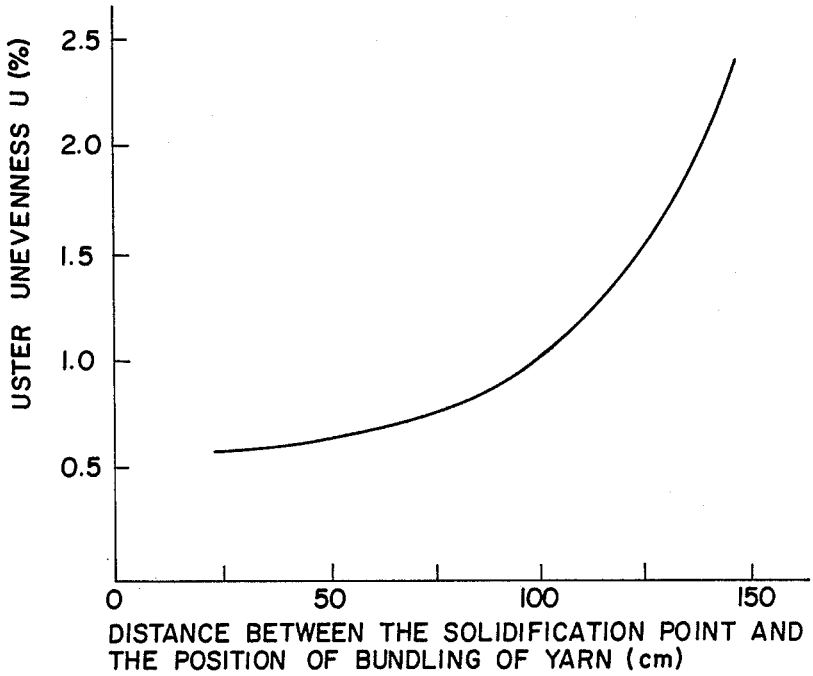

However, in this process, the spun yarn occasionally shakes due to the ambient air, which causes occurrence of undesirable denier unevenness in the longitudinal direction of the yarn (cf. W. Stein; Int. Text. Bull., World Ed., Spinning (3) 259, 1981). As a result of intensive study by the present inventors, it has been found that the shaking of spun yarn owing to the ambient air can be prevented by arranging a device for bundling yarn at the position of 20 to 100 cm below the solidification point of yarn. When the position of arranging the bundling device is shorter than 20 cm from the solidification point of filament, the yarn occasionally hangs on the device, and on the other hand, when the position of arranging the bundling device is longer than 100 cm, the undesirable shaking of yarn cannot effectively be prevented. The accompanying FIG. 2 shows the relation between the Uster unevenness U% of POY and the distance between the solidification point and the position of bundling.

In this process, the starting polyester should have an intrinsic viscosity of 0.8 or more; the throughput of the polyester should be not more than 3.5 g/minute per each orifice of the spinneret; and the spinning stress at a solidification point of filament should be in the range of $1.5\times10^7$ to $7.5\times10^7$ dyne/cm$^2$, because of the reasons as explained in the above other process. Besides, when the spinning speed is lower than 1,500 m/minute, the resultant fiber shows less molecular orientation and hence less thermal dimensional stability.

The present invention is illustrated by the following Examples but should not be construed to be limited thereto.

Example 1

Polyethylene terephthalate (intrinsic viscosity: 1.0, diethylene glycol content: 1.0% by mole, carboxyl group content: 10 equivalent/$10^6$ g) was spun and drawn under the conditions as shown in Table 1.

The processes A, B and C were effective in from industrial view point, but the process D, wherein a hot roll was used in the first drawing stage but no heated steam was used, showed remarkable breaking of yarn and hence was not suitable for industrial production of the fiber. The process E, wherein heated steam was used but a two drawing system was not applied, required too much heated steam and an extremely high utility cost, and hence, it was not suitable for industrial production of the fiber, either. Besides, the process F, wherein the throughput of the starting polymer was larger than 3.5 g/minute per each orifice of the spinneret and the final winding-up speed was higher than 5,000 m/minute, showed remarkable breaking of yarn and poor operability. In order to make the final winding-up speed lower than 5,000 m/minute, it was necessary to make the birefringence of spun yarn to be sent to the first godet roll higher while keeping the spinning speed as low as possible. For such purpose, it is necessary to control the intrinsic viscosity of the polymer at 0.8 or more, the extruding temperature in the range of 280° to 325° C., and the throughput in not more than 3.5 g/minute per each orifice. In the case of process G which was done by a conventional spin-draw method, the spinning stress at the solidification point was very low, and the resultant yarn had a high dry heat shrinkage.

TABLE 1

| | A | B | C | D | E | F | G |
|---|---|---|---|---|---|---|---|
| Polymer temperature (°C.) | 315 | 315 | 315 | 315 | 315 | 315 | 310 |
| Throughput per each orifice (g/min) | 1.67 | 1.56 | 2.17 | 1.67 | 2.17 | 3.86 | 2.10 |
| Number of orifice | 500 | 500 | 380 | 500 | 380 | 240 | 190 |
| Distance between the spinneret surface and quenching position (cm) | 15 | 15 | 28 | 15 | 28 | 28 | 30 |
| Temp. of quenching air (°C.) | 60 | 80 | 60 | 60 | 60 | 60 | room temp. |
| Velocity of quenching air (cm/sec) | 40 | 50 | 50 | 40 | 50 | 50 | 50 |
| First godet roll speed (m/min) | 2000 | 1930 | 1720 | 2000 | 1720 | 1980 | 700 |
| Temp. of the first godet roll (°C.) | room temp. | room temp. | room temp. | 90 | room temp. | room temp. | 95 |
| Average birefringence of spun yarn | 0.030 | 0.033 | 0.023 | could not be measured | 0.023 | 0.023 | 0.002 |
| Difference of birefringence between the surface and center of filament | 0.0015 | 0.0005 | 0.001 | could not be measured | 0.001 | 0.001 | 0.000 |
| Spinning stress at solid. point (dyne/cm$^2$) | $3.0 \times 10^7$ | $3.3 \times 10^7$ | $2.3 \times 10^7$ | $3.0 \times 10^7$ | $2.3 \times 10^7$ | $2.3 \times 10^7$ | $1.3 \times 10^6$ |
| Temp. of heated steam (°C.) | 550 | 550 | 445 | — | 445 | 550 | — |
| Amount of heated steam (kg/hr) | 32.2 | 28.1 | 32.2 | 0 | 74.2 | 39.0 | 0 |
| Amount of heated steam/ amount of polymer (kg/kg) | 0.64 | 0.60 | 0.65 | 0 | 1.5 | 0.70 | 0 |
| Peripheral speed of the second godet roll (m/min) | 4420 | 4398 | 4500 | 4320 | 5000 | 4913 | 2772 |
| Temp. of the second godet roll (°C.) | 200 | 200 | 200 | 160 | 200 | 200 | 160 |
| Draw ratio at the first drawing stage | 2.21 | 2.28 | 2.616 | 2.16 | 2.907 | 2.481 | 3.96 |
| Peripheral speed of the third godet roll (m/min) | 5080 | 4750 | 5000 | 5080 | 4920 | 5650 | 3465 |
| Temp. of the third godet roll (°C.) | 220 | 215 | 220 | 220 | 140 | 220 | 220 |
| Draw ratio at the second drawing stage | 1.149 | 1.08 | 1.111 | 1.176 | 0.984 | 1.150 | 1.25 |
| Peripheral speed of the fourth godet roll (m/min) | 5000 | 4674 | 4920 | 5000 | — | 5560 | 3958 |
| Temp. of the fourth godet roll (°C.) | 140 | 140 | 140 | 140 | — | 140 | 140 |
| Draw ratio at the third drawing stage | 0.984 | 0.984 | 0.984 | 0.984 | — | 0.984 | 1.15 |
| Times of breaking of drawn yarn (times/ton) | 0.97 | 0.82 | 1.21 | 17.2 | 1.1 | 9.8 | 0.23 |
| Intrinsic viscosity of drawn yarn | 0.88 | 0.88 | 0.88 | 0.88 | 0.88 | 0.88 | 0.88 |
| Carboxyl group content (equivalent/$10^6$ g) | 17 | 17 | 17 | 17 | 17 | 17 | 17 |
| Average birefringence of drawn yarn | 0.194 | 0.192 | 0.192 | 0.193 | 0.195 | 0.191 | 0.193 |
| Birefringence of surface of drawn yarn | 0.194 | 0.193 | 0.193 | 0.194 | 0.197 | 0.192 | 0.194 |
| Birefringence of center of drawn yarn | 0.193 | 0.192 | 0.191 | 0.193 | 0.194 | 0.191 | 0.192 |
| Yarn tenacity (g/d) | 8.7 | 8.6 | 8.8 | 8.5 | 8.8 | 8.6 | 9.0 |
| Treatment at const. length at 240° C. for 1 min: | | | | | | | |
| Work loss at 150° C. | 0.0155 | 0.0150 | 0.0174 | 0.0158 | 0.0161 | 0.0185 | 0.027 |

TABLE 1-continued

| | A | B | C | D | E | F | G |
|---|---|---|---|---|---|---|---|
| (inch · pound/1000 d) | | | | | | | |
| Dry heat shrinkage at 175° C. (%) | 2.2 | 2.4 | 2.3 | 2.5 | 2.3 | 2.3 | 4.8 |

Example 2

As to the fibers produced by the processes A and C in Table 1 in Example 1 (fibers of the present invention) and the fiber produced by the process G (the conventional high tenacity fiber as a reference), the characteristics as a tire cord were compared.

Each fiber was made a cord of two folded yarn having a number of twist of 40×40 (T/10 cm), and the resulting cord was dipped in a resorcinol-formalin-latex treating liquid containing Vulcabond E (old name: Pexul, manufactured by VULNAX) (treating temperature: 240° C.) The dipped cord characteristics of these three cords were compared. The results are shown in Table 2.

TABLE 2

| | A | C | G |
|---|---|---|---|
| Tensile Strength (kg) | 22.4 | 22.6 | 22.4 |
| Elongation at break (%) | 14.0 | 13.8 | 15.5 |
| Elongation at 6.8 kg (%) | 5.1 | 5.0 | 5.3 |
| Dry heat shrinkage at 150° C. (%) | 2.3 | 2.5 | 4.5 |
| Dip pick up (%) | 6.2 | 5.5 | 6.0 |
| H adhesion (kg/cm) | 17.2 | 17.5 | 17.3 |
| Adhesion in peeling (kg/inch) | 25.8 | 24.3 | 23.1 |
| After deteriorated in rubber at 160° C. for 3 hours: | | | |
| Tensile strength (kg) | 14.9 | 15.1 | 15.3 |
| Retention of strength (%) | 66.5 | 66.8 | 68.3 |
| Disc fatigue test (retention of strength: %) | 95 | 94 | 90 |
| Tube fatigue test (duration: min) | 405 | 453 | 157 |

As is clear from the above Table 2, the fibers obtained by the present invention showed the same tensile strength and chemical stability as those of the conventional high tenacity polyester fiber and showed remarkable improved dimensional stability.

Based on these tests, it is confirmed that the present invention can give the excellent fiber at comparatively low cost.

Example 3

Polyethylene terephthalate (intrinsic viscosity: 1.0, diethylene glycol content: 1.0% by mole, carboxyl group content: 10 equivalent/$10^6$ g) was spun and drawn under the conditions as shown in Table 3. The results are shown in Table 3, H–M.

The process H, wherein the throughput of polymer per each orifice was over 3.5 g/minute, showedabig difference of birefringence between the surface and center of the filament of spun yarn and less effect of the high temperature quenching air (positive quenching at a high temperature), and hence, the spun yarn had lower birefringence and the desired polyester fiber having high tenacity and low shrink could not be obtained.

In both the process J wherein the spinning stress at the solidification point was somewhat lower than $1.5\times10^7$ dyne/cm$^2$, and the process I wherein the spinning stress at the solidification point was remarkably lower than $1.5\times10^7$ dyne/cm$^2$, the dry heat shrinkage of the fibers was large, and hence, there could not be obtained the desired polyester fiber having a low shrink.

In the case of process K wherein the spinning stress at the solidification point was larger than $7.5\times10^7$ dyne/cm$^2$, the spun yarn was already crystallized (measured by a wide angle X-ray diffraction), and the birefringence distribution in the filament of spun yarn became remarkably large, and hence, breaking of drawn yarn occurred frequently and the fiber obtained after drawing showed extremely lower tenacity.

In the case of process L of the present invention wherein the temperature of quenching air was 50° C., there could be obtained the desired fiber while the breaking of yarn was observed to some extent, but on the other hand, in the case of process M wherein the temperature of quenching air was 30° C. which is lower than the range of the present invention, the produced fiber had lower tenacity and the breaking of yarn occurred very frequently.

TABLE 3

| | H | I | J | K | L | M |
|---|---|---|---|---|---|---|
| Polymer temperature (°C.) | 315 | 315 | 315 | 315 | 315 | 315 |
| Throughput per each orifice (g/min) | 3.8 | 3.07 | 3.4 | 1.2 | 1.82 | 1.88 |
| Number of orifice | 240 | 190 | 288 | 500 | 500 | 500 |
| Distance between the spinneret surface and quenching position (cm) | 28 | 30 | 30 | 15 | 28 | 28 |
| Temp. of quenching air (°C.) | 60 | 20 | 20 | 60 | 50 | 30 |
| Velocity of quenching air (cm/sec) | 40 | 50 | 50 | 50 | 40 | 40 |
| Peripheral speed of the first godet roll (m/min) | 2000 | 614 | 1500 | 3500 | 2500 | 2500 |
| Temp. of the first godet roll (°C.) | room temp. | room temp. | room temp. | room temp. | room temp. | room temp. |
| Average birefringence of spun yarn | 0.024 | 0.0024 | 0.0115 | 0.085 | 0.038 | 0.034 |
| Difference of birefringence between the surface and center of filament | 0.004 | 0.0001 | 0.0012 | 0.015 | 0.002 | 0.005 |
| Spinning stress at solid. point (dyne/cm$^2$) | $2.4\times10^7$ | $2.4\times10^6$ | $1.15\times10^7$ | $8.5\times10^7$ | $3.8\times10^7$ | $3.4\times10^7$ |
| Temp. of heated steam (°C.) | 525 | 445 | 445 | 480 | 480 | 480 |
| Amount of heated steam (kg/hr) | 50.3 | 16.3 | 38.2 | 38.8 | 38.8 | 38.8 |
| Amount of heated steam/ | 0.92 | 0.47 | 0.65 | 1.08 | 0.71 | 0.71 |

TABLE 3-continued

| | H | I | J | K | L | M |
|---|---|---|---|---|---|---|
| amount of polymer (kg/kg) | | | | | | |
| Peripheral speed of the second godet roll (m/min) | 4772 | 3500 | 5800 | 5555 | 4991 | 5176 |
| Temp. of the second godet roll (°C.) | 200 | 220 | 220 | 200 | 200 | 200 |
| Draw ratio at the first drawing stage | 2.386 | 5.70 | 3.87 | 1.587 | 1.996 | 2.070 |
| Peripheral speed of the third godet roll (m/min) | 5488 | 3500 | 5800 | 6000 | 5540 | 5750 |
| Temp. of the third godet roll (°C.) | 220 | 120 | 140 | 220 | 220 | 220 |
| Draw ratio at the second drawing stage | 1.15 | 1.0 | 1.0 | 1.080 | 1.110 | 1.111 |
| Peripheral speed of the fourth godet roll (m/min) | 5400 | — | — | 6000 | 5450 | 5658 |
| Temp. of the fourth godet roll (°C.) | 140 | — | — | 140 | 140 | 140 |
| Draw ratio at the third drawing stage | 0.984 | — | — | 1.0 | 0.984 | 0.984 |
| Times of breaking of drawn yarn (times/ton) | 3.37 | 0.2 | 2.32 | Frequently | 2.59 | 5.11 |
| Intrinsic viscosity of drawn yarn | 0.88 | 0.89 | 0.88 | 0.88 | 0.88 | 0.88 |
| Carboxyl group content (equivalent/$10^6$ g) | 17 | 17 | 17 | 17 | 17 | 17 |
| Average birefringence of drawn yarn | 0.184 | 0.202 | 0.176 | 0.175 | 0.192 | 0.181 |
| Birefringence of surface of drawn yarn | 0.189 | 0.203 | 0.178 | 0.185 | 0.194 | 0.187 |
| Birefringence of center of drawn yarn | 0.182 | 0.202 | 0.175 | 0.172 | 0.191 | 0.175 |
| Yarn tenacity (g/d) | 8.1 | 9.5 | 7.2 | 7.3 | 8.5 | 7.9 |
| Treatment at const. length at 240° C. for 1 min: | | | | | | |
| Work loss at 150° C. (inch · pound/1000 d) | 0.162 | 0.0394 | 0.0373 | 0.117 | 0.153 | 0.0149 |
| Dry heat shrinkage at 175° C. (%) | 2.8 | 4.5 | 3.5 | 1.8 | 2.3 | 2.4 |

Example 4

Polyethylene terephthalate (intrinsic viscosity: 1.0, diethylene glycol content: 1.0% by mole, carboxyl group content: 10 equivalent/$10^6$ g) was melt-spun and drawn under the conditions as shown in Table 4.

As is clear from Table 4, the drawn yarns produced by the processes N to Q were markedly superior to the reference yarn produced by the conventional process R in thermal stability and further were markedly superior to the reference yarn (low shrinkage yarn) produced by the conventional POY process S (cf. Japanese Patent Application No. 119614/1981) in tenacity and chemical stability.

The "% Broken Bonds" used in Table 4 as an index of resistance to hydrolysis means the ratio of scission of ester bonds by hydrolysis to total ester bonds and is calculated by the following formula:

$$\%\ \text{Broken Bonds} = 0.244 \times ([\eta]_{final}^{-1.471} - [\eta]_{initial}^{-1.471}) \quad (4)$$

wherein $[\eta]$final means an intrinsic viscosity of fiber after being deteriorated, and $[\eta]$initial means an intrinsic viscosity of fiber before deterioration.

The above formula (4) was derived based on the following relation between the intrinsic viscosity (measured at 25° C. in a mixed solvent of phenol/tetrachloroethane=6/4): $[\eta]_{P/TCE=6/4}{}^{25°\,C.}$ and the number average molecular weight: $\overline{Mn}$ $$[\eta]_{P/TCE=6/4}{}^{25°\,C.} = 7.5 \times 10^{-4}\overline{Mn}^{0.64}$$

(cf. L. D. Moore Jr.; Cleveland A.C.S. Meeting 4/1960, Vol. 1, page 234).

TABLE 4

| | N | O | P | Q | R | S |
|---|---|---|---|---|---|---|
| Polymer temperature (°C.) | 320 | 320 | 320 | 320 | 310 | 305 |
| Throughput per each orifice (g/min) | 1.75 | 1.33 | 1.89 | 2.52 | 2.32 | 1.82 |
| Number of orifice | 380 | 500 | 380 | 240 | 190 | 380 |
| Distance between the spinneret surface and quenching position (cm) | 30 | 30 | 30 | 30 | 30 | 28 |
| Temp. of quenching air (°C.) | 55 | 60 | 50 | 65 | 20 | 20 |
| Velocity of quenching air (cm/sec) | 50 | 40 | 50 | 40 | 40 | 40 |
| Spinning speed (m/min) | 2500 | 2000 | 2500 | 2700 | 700 | 2500 |
| Spinning stress at solid. point (dyne/$cm^2$) | $3.65 \times 10^7$ | $2.52 \times 10^7$ | $3.45 \times 10^7$ | $4.74 \times 10^7$ | $1.3 \times 10^6$ | $3.26 \times 10^7$ |
| Average birefringence of spun yarn | 0.036 | 0.025 | 0.035 | 0.050 | 0.002 | 0.033 |

TABLE 4-continued

| | N | O | P | Q | R | S |
|---|---|---|---|---|---|---|
| Difference of birefringence between surface and center of filament | 0.002 | 0.001 | 0.003 | 0.003 | 0.000 | 0.005 |
| Temp. in the first drawing (°C.) | 80 | 83 | 80 | 75 | 95 | 82 |
| Draw ratio in the first drawing | 1.60 | 1.90 | 1.72 | 1.50 | 3.96 | 1.73 |
| Temp. in the second drawing (°C.) | 160 | 160 | 160 | 160 | 160 | 160 |
| Draw ratio in the second drawing | 1.30 | 1.30 | 1.30 | 1.20 | 1.25 | 1.30 |
| Temp. in the third drawing (°C.) | 240 | 230 | 240 | 240 | 220 | 210 |
| Draw ratio in the third drawing | 1.15 | 1.20 | 1.15 | 1.11 | 1.15 | 1.1 |
| Intrinsic viscosity of drawn yarn | 0.88 | 0.88 | 0.88 | 0.88 | 0.88 | 0.90 |
| Diethylene glycol content (mole %) | 1.0 | 1.0 | 1.0 | 1.0 | 1.0 | 1.0 |
| Carboxyl group content (equivalent/$10^6$ g) | 16 | 17 | 17 | 17 | 17 | 16 |
| Average birefringence of spun yarn (a) | 0.195 | 0.200 | 0.193 | 0.205 | 0.193 | 0.180 |
| Birefringence of surface of filament (b) | 0.198 | 0.203 | 0.199 | 0.209 | 0.194 | 0.185 |
| Birefringence of center of filament (c) | 0.190 | 0.199 | 0.190 | 0.201 | 0.192 | 0.170 |
| Difference of birefringence between surface and center of filament (d) = (b) − (c) | 0.008 | 0.004 | 0.009 | 0.008 | 0.002 | 0.015 |
| Ratio of (d)/(a) | 0.041 | 0.020 | 0.047 | 0.039 | 0.010 | 0.083 |
| Denier of filament | 2.63 | 2.01 | 2.64 | 4.16 | 5.26 | 2.63 |
| Yarn tenacity (g/d) | 8.7 | 8.9 | 8.6 | 8.8 | 9.0 | 8.1 |
| Dry heat shrinkage at 175° C. (%) | 6.9 | 7.3 | 6.2 | 6.8 | 15.0 | 7.5 |
| Work loss at 150° C. (inch · pound/1000 d) | 0.0248 | 0.0263 | 0.0230 | 0.0257 | 0.040 | 0.0270 |
| Treatment at constant length at 240° C. for 1 minute: | | | | | | |
| Dry heat shrinkage at 175° C. (%) | 2.7 | 2.8 | 2.3 | 2.2 | 4.8 | 2.5 |
| Work loss at 150° C. (inch · pound/1000 d) | 0.0178 | 0.0193 | 0.0158 | 0.0163 | 0.027 | 0.019 |
| Hydrolysis with saturated steam at 150° C. for 16 hours: | | | | | | |
| Yarn tenacity (g/d) | 5.1 | 5.3 | 5.0 | 5.2 | 5.3 | 4.0 |
| Retention of tenacity (%) | 59 | 60 | 58 | 59 | 59 | 49 |
| Intrinsic viscosity | 0.43 | 0.45 | 0.44 | 0.45 | 0.44 | 0.38 |
| % Broken Bonds (%) | 0.55 | 0.50 | 0.52 | 0.50 | 0.52 | 0.73 |
| Deterioration in rubber at 160° C. for 3 hours: | | | | | | |
| Yarn tenacity (g/d) | 7.3 | 7.7 | 7.1 | 7.4 | 7.6 | 5.8 |
| Retention of tenacity (%) | 84 | 86 | 83 | 84 | 84 | 77 |

Example 5

Polyethylene terephthalate (intrinsic viscosity: 1.0, diethylene glycol content: 0.9% by mole, carboxyl group content: 12 equivalent/$10^6$ g) was melt-spun by adding under pressure tributylphosphine (0.03% by weight) and ortho-phenylphenol glycidyl ether (0.5% by weight) to a molten polymer in an extruder, extruding the molten mixture from orifices of a spinneret (number of orifice: 380) at a polymer temperature of 315° C. and in a throughput of 2.17 g/minute per each orifice, and the spun yarn was quenched with quenching air of 60° C. in a distance between the spinneret surface and quenching position of 28 cm and at a velocity of air of 0.5 m/second. The quenched spun yarn was finished with spinning lubricant containing 20% by weight of epoxylated glycerin and then was supplied to the first godet roll at a speed of 1720 m/minute, in which the spun yarns had an average birefringence of 0.023, a birefringence of surface area of filament of 0.024, and a birefringence of center of filament of 0.023, i.e. the difference of birefringence between surface area and center of filament being merely 0.001. The resulting spun yarns were immediately drawn at a draw ratio of 2.86 by using heated steam of 445° C., and then were wound-up at a rate of 4920 m/minute to give the desired fiber of the present invention (this process is referred to in Table 5 as "T").

For comparison purposes, polyethylene terephthalate (intrinsic velocity: 1.0, diethylene glycol content: 0.9% by mole, carboxyl group content: 12 equivalent/$10^6$ g) was melt-spun by extruding a molten polymer from orifice of a spinneret (number of orifice: 190) at a polymer temperature of 315° C. and in a throughput of 3.07 g/minute per each orifice, and the spun yarns were passed through a heated tube at 350° C. for a distance of 30 cm and were quenched with quenching air of 20° C. at an air velocity of 0.5 m/second, and then was supplied to the first godet roll at a speed of 614 m/minute, in which the spun yarns had an average birefringence of 0.0024 and uniform birefringence within the filaments. The resulting spun yarns were immediately drawn at a draw ratio of 5.7 by using heated steam of 445° C. and were wound-up at a rate of 3500 m/minute to give a fiber (this process is referred to in Table 5 as "U")

The characteristics of the fibers are shown in Table 5.

TABLE 5

| | T | U |
|---|---|---|
| Intrinsic viscosity of fiber | 0.90 | 0.90 |
| Carboxyl group content (equivalent/$10^6$ g) | 6 | 18 |
| Average birefringence (a) | 0.195 | 0.193 |
| Birefringence of surface of filament (b) | 0.197 | 0.193 |
| Birefringence of center of filament (c) | 0.194 | 0.193 |
| Difference of birefringence between the surface and center of filament (d) = (b) − (c) | 0.003 | 0 |

TABLE 5-continued

| | T | U |
|---|---|---|
| Ratio of (d)/(a) | 0.015 | 0 |
| Denier of filament | 3.96 | 7.97 |
| Yarn tenacity (g/d) | 8.8 | 9.1 |
| Treatment at constant length at 240° C. for 1 minute: | | |
| Work loss at 150° C. (inch · pound/1000 d) | 0.0161 | 0.030 |
| Dry heat shrinkage at 175° C. (%) | 2.3 | 5.0 |
| Hydrolysis with saturated steam at 150° C. for 16 hours: | | |
| Yarn tenacity (g/d) | 6.2 | 5.2 |
| Retention of tenacity (%) | 70 | 57 |
| Intrinsic viscosity | 0.50 | 0.44 |
| % Broken Bonds (%) | 0.392 | 0.532 |

The fibers obtained above were each made a cord of two folded yarn having a number of twist of 40×40 (T/10 cm), and the resulting cords were each dipped in a resorcinol-formalin-latex dipping liquid (one step dipping system, treating temperature: 240° C.).

Separately, the fiber produced by the process U was dipped in a two-step dipping solution containing Vulcabond E (old name: Pexul, manufactured by VULNAX) at a treating temperature of 240° C.

The dip cord characteristics of the three cords thus obtained were compared. The results are shown in Table 6.

TABLE 6

| | T | U | |
|---|---|---|---|
| | | U-1 | U-2 |
| Dipping solution | RFL* | RFL* | Vulcabond E + RFL* |
| Tensile strength (kg) | 22.5 | 22.5 | 22.1 |
| Elongation at break (%) | 14.8 | 15.3 | 15.1 |
| Elongation at 6.8 kg (%) | 5.0 | 5.3 | 5.3 |
| Dry heat shrinkage at 150° C. (%) | 2.3 | 4.5 | 4.5 |
| Dip pick up (%) | 4.3 | 4.2 | 6.0 |
| H adhesion (kg/cm) | 15.8 | 8.3 | 16.0 |
| Adhesion in peeling (kg/inch) | 26.3 | 13.0 | 25.8 |
| After deteriorated in rubber at 160° C. for 3 hours: | | | |
| Tensile strength (kg) | 20.7 | 19.1 | 18.3 |
| Retention of strength (%) | 92 | 85 | 83 |
| Disc fatigue test (retention of strength: %) | 92 | 90 | 86 |
| Tube fatigue test (duration: min) | 643 | 203 | 198 |

*RFL: Resorcinol-formalin-latex dipping solution

As is clear from Table 6, the fiber of the present invention produced by the process T showed similar tenacity to that of the high tenacity fiber produced by the conventional process and showed highly improved chemical stability and thermal dimensional stability. Moreover, when the fiber of the present invention was subjected to surface treatment with an epoxy resin, etc., it became more effective as a tire cord.

Example 6

Polyethylene terephthalate (intrinsic viscosity: 1.0, diethylene glycol content: 1.2% by mole, carboxyl group content: 20 equivalent/$10^6$ g) was molten with an extruder and then spun under the conditions as shown in Table 7. The properties of the yarns thus obtained are shown in Table 7.

As is clear from Table 7 the processes V to X could give POY having higher birefringence at a lower spinning speed in comparison with the reference process Y wherein quenching air (a conventional cool quenching air) was used. Besides, the POY produced by the processes V to X showed a smaller difference of birefringence between the inner and outer layers of filament and superior uniformity in comparison with the POY produced by the conventional process Y and further, the yarns of the processes V to X showed the same quality level as the yarn of the conventional process Y in the Uster unevenness (U%).

TABLE 7

| | V | W | X | Y |
|---|---|---|---|---|
| Polymer temperature (°C.) | 320 | 320 | 320 | 320 |
| Intrinsic viscosity | 0.91 | 0.91 | 0.90 | 0.91 |
| Throughput per each orifice (g/min) | 2.00 | 2.00 | 2.63 | 2.63 |
| Number of orifice | 250 | 250 | 190 | 190 |
| Distance between spinneret surface and quenching position (cm) | — | — | — | 30 |
| Velocity of quenching air (m/sec) | — | — | — | 0.4 |
| Temp. of quenching air (°C.) | — | — | — | 20 |
| Spinning speed (m/min) | 2500 | 2000 | 2400 | 2500 |
| Distance between the spinneret surface and solid. point (cm) | 195 | 180 | 200 | 105 |
| Spinning stress at solidification point (dyne/$cm^2$) | 5.4 × $10^7$ | 3.1 × $10^7$ | 4.0 × $10^7$ | 3.3 × $10^7$ |
| Distance of bundling point* (cm) | 220 | 210 | 225 | 450 |
| Average birefringence of spun yarn (a) | 0.054 | 0.031 | 0.040 | 0.030 |
| Birefringence of surface of filament (b) | 0.056 | 0.031 | 0.041 | 0.033 |
| Birefringence of center of filament (c) | 0.053 | 0.031 | 0.040 | 0.028 |
| Difference of birefringence between surface and center of filament (d) = (b) − (c) | 0.003 | 0.000 | 0.001 | 0.005 |
| Ratio of (d)/(a) | 0.056 | 0.000 | 0.025 | 0.167 |
| CV value of birefringence** between filaments (%) | 5.2 | 4.3 | 4.6 | 6.8 |
| Denier of monofilament | 7.2 | 9.0 | 9.85 | 9.47 |
| Uster unevenness U (%) | 0.58 | 0.65 | 0.63 | 0.61 |

*Vertical distance from the spinneret to the position of bundling of the yarns
**Coefficient of variation

Example 7

The effect of the position of bundling of yarns on the properties thereof was examined.

The process V in Example 6 was repeated except that the position of the bundling of yarn was varied, and then, the relation of the distance between the solidification point of yarn and the position of bundling of yarn and the Uster unevenness was determined. The results are shown in attached FIG. 2. As is clear from FIG. 2, it is preferable to set the position of bundling of yarn to 20 to 100 cm below the solidification point from the veiwpoint of depressing the occurrence of denier unevenness.

Example 8

The same polyethylene terephthalate as in Example 6 was spun under the same conditions as in the process W in Example 6. The spun yarn was passed through the first godet roll (at room temperature) and was immediately drawn with heated steam of 550° C. at a draw ratio of 2.21 and passed through the second godet roll (peripheral speed: 4420 m/minute, temperature: 200° C.), and further, was drawn at a draw ratio of 1.149 between the second godet roll and the third godet roll (peripheral speed: 5080 m/minute, temperature: 220° C.), and was relaxed with the fourth godet roll (peripheral speed: 5000 m/minute, temperature: 140° C.) in a ratio of 1.6%, and finally was taken off to give the yarn of the present invention (this process is referred to in Table 8 as "Z"). The properties of the yarn are shown in Table 8 together with the data of the reference yarn produced by the process R in Table 4.

TABLE 8

| | Z | R |
|---|---|---|
| Denier of yarn | 908 | 999 |
| Yarn tenacity (g/d) | 8.7 | 9.0 |
| Tensile strength (kg) | 7.9 | 9.0 |
| Elongation at break (%) | 9.8 | 12.5 |
| Elongation at 4.5 g/d (%) | 5.0 | 5.6 |
| Average birefringence of spun yarn | 0.195 | 0.193 |
| Birefringence of surface of filament | 0.195 | 0.194 |
| Birefringence of center of filament | 0.195 | 0.192 |
| Treatment at constant length at 240° C. for 1 minute: | | |
| Work loss at 150° C. (inch pound/1000 d) | 0.0149 | 0.027 |
| Dry heat shrinkage at 175° C. (%) | 2.2 | 4.8 |

As is clear from Table 8, the fiber produced by the present process Z showed superior thermal stability in comparison with the fiber produced by the conventional process R.

The solidification point of yarn in the above Examples was measured in the following manner.

As to the filament spun from spinneret surface, the diameter thereof was measured with a device for measuring the outer diameter (manufactured by Zimmer Co.), and the variation of diameter along a filament was observed. When no variation of diameter was observed, it was defined as the point of complete solidification of the filament (yarn).

What is claimed is:

1. A polyester fiber having excellent thermal dimensional stability and chemical stability as well as high tenacity, comprising a drawn yarn produced by melt-spinning a polyester comprising predominantly polyethylene terephthalate, solidifying the spun yarn with cooling and then drawing the yarn, and having the following properties:

(i) intrinsic viscosity: 0.8 or more;

(ii) content of diethylene glycol: approximately 2.5% of terephthalic acid residue;

(iii) content of carboxyl groups: 30 equivalent/$10^6$ g or less;

(vi) average birefringence: 0.190 or more;

(v) yarn tenacity: 8.5 g/d or more; and (vi) value obtained by dividing the difference of birefringence between surface and center of monofilament by average birefringence: 0.555 or less, said polyester fiber further having the following properties when it is heat-treated at constant length at 240° C. for one minute:

(a) dry heat shrink when freely heat-treated at 175° for 30 minutes: 3.0% or less, and (b) work loss when the hysteresis loop is measured at a stress between 0.6 g/d and 0.05 g/d under the following conditions length of test sample of 10 inch, strain rate of 0.5 inch/minute and a temperature of 150° C.: $2.0\times10^{-5}$ inch-pound-/denier or less.

2. A polyester fiber according to claim 1, wherein the content of carboxyl group is 12 equivalent/$10^6$ g or less.

3. A polyester fiber according to claim 1, which is subjected to surface treatment with a compound selected from an epoxy compound and an isocyanate compound in the spinning and drawing steps.

4. A rubber goods which is reinforced with the polyester fiber as set forth in claim 1.

5. A rubber goods according to claim 4, wherein the polyester fiber has a content of carboxyl group of 12 equivalent/$10^6$ g or less.

6. A rubber goods according to claim 4, wherein the polyester fiber is subjected to surface treatment with a compound selected from an epoxy compound and an isocyanate compound in the spinning and drawing steps.

7. A rubber goods according claim 4, which is a tire.

8. A rubber goods according to claim 5, wherein the polyester fiber is subjected to surface treatment with a compound selected from an epoxy compound and an isocyamate compound in the spinning and drawing steps.

9. A rubber goods according to claim 5, which is a tire.

10. A rubber goods according to claim 6, which is a tire.

* * * * *

UNITED STATES PATENT AND TRADEMARK OFFICE

CERTIFICATE OF CORRECTION

PATENT NO. : 4,827,999

DATED : September 15, 1989

INVENTOR(S) : Kazuyuki Yabuki

It is certified that error appears in the above-identified patent and that said Letters Patent is hereby corrected as shown below:

Claim 1, column 22, line 15, between "conditions" and "length" insert --:--.

Claim 8, column 22, line 39, change "isocyamate" to --isocyanate--.

The assignee should be change from "Toyobo Petcord Co., Ltd., Osaka, Japan" to --Toyo Boseki Kabushiki Kaisha, Osaka, Japan--.

Signed and Sealed this

Nineteenth Day of June, 1990

*Attest:*

*Attesting Officer*

HARRY F. MANBECK, JR.

*Commissioner of Patents and Trademarks*